US009863423B2

(12) United States Patent
Bachellier

(10) Patent No.: US 9,863,423 B2
(45) Date of Patent: Jan. 9, 2018

(54) CONICAL IMPELLER AND APPLICATIONS THEREOF

(71) Applicant: Enevor Inc., Albuquerque, NM (US)

(72) Inventor: Carl Roy Bachellier, Dundas (CA)

(73) Assignee: Enevor Inc., Albuquerque, NM (US)

( * ) Notice: Subject to any disclaimer, the term of this patent is extended or adjusted under 35 U.S.C. 154(b) by 180 days.

(21) Appl. No.: 14/686,682

(22) Filed: Apr. 14, 2015

(65) Prior Publication Data

US 2015/0292523 A1 Oct. 15, 2015

Related U.S. Application Data

(60) Provisional application No. 61/979,383, filed on Apr. 14, 2014, provisional application No. 61/985,971, (Continued)

(51) Int. Cl.
*F04D 13/08* (2006.01)
*F04D 7/04* (2006.01)
(Continued)

(52) U.S. Cl.
CPC ..... *F04D 7/045* (2013.01); *F04D 13/08* (2013.01); *F04D 29/2216* (2013.01);
(Continued)

(58) Field of Classification Search
None
See application file for complete search history.

(56) References Cited

U.S. PATENT DOCUMENTS 344,534 A 6/1886 Madsen
665,580 A 1/1901 Price
(Continued)

FOREIGN PATENT DOCUMENTS

CA 1259068 A1 9/1989
CN 202506329 10/2012
(Continued)

OTHER PUBLICATIONS

Jones, et al., "Pumping Station Design: Revised 3rd Edition", Elsevier, Inc., 2008, 11.39.

*Primary Examiner* — Dwayne J White
*Assistant Examiner* — Theodore Ribadeneyra
(74) *Attorney, Agent, or Firm* — Philip D. Askenazy; Deborah A. Peacock; Peacock Myers, P.C.

(57) ABSTRACT

A conical impeller with a hub that has a conical surface extending into the interior of the impeller. The hub has spiral, slanting arms which are attached or integrally formed with a plurality of curved blades. The blades can be connected at the bottom by a ring. The intersection of the conical surface of the hub with the blade forms an upward path for fluids and their entrained particles or gases which have been brought into the interior of the impeller to effectively completely be ejected. The discharge edges of the blades and/or the conical surface of the hub may have openings for discharging gas into the fluid. The impeller imparts low shear to the fluid and its components, and the shear is independent or only depends slightly on the size of the impeller. The impeller minimizes or eliminates particle agglomeration and fouling of the impeller. The efficiency of and flow pattern produced by the impeller means that containers don't require the use of baffles. The high efficiency and low shear of the impeller is useful for applications such as mixing of biological fluids, decontamination of produced water, chemical mechanical polishing, and flotation cells.

23 Claims, 11 Drawing Sheets

Related U.S. Application Data filed on Apr. 29, 2014, provisional application No. 61/985,962, filed on Apr. 29, 2014, provisional application No. 61/985,941, filed on Apr. 29, 2014, provisional application No. 61/987,075, filed on May 1, 2014.

(51) Int. Cl.
*F04D 29/22* (2006.01)
*F04D 29/18* (2006.01)
*F04D 29/70* (2006.01)

(52) U.S. Cl.
CPC ..... *F04D 29/2222* (2013.01); *F04D 29/181* (2013.01); *F04D 29/708* (2013.01)

(56) References Cited

U.S. PATENT DOCUMENTS 2,008,106 A 7/1935 Lawrence
3,442,220 A * 5/1969 Mottram ..... F04D 9/002 415/156
3,512,762 A 5/1970 Umbricht
3,975,469 A * 8/1976 Fuchs ..... B01F 3/04539 261/87
4,200,597 A * 4/1980 Baum ..... A01C 3/026 210/219
4,231,974 A 11/1980 Engelbrecht et al.
4,371,480 A 2/1983 Vos
4,776,753 A 10/1988 Weinrib
4,844,043 A 7/1989 Rajendren
4,844,843 A * 7/1989 Rajendren ..... B01F 3/04539 261/30
5,051,213 A 9/1991 Weske
5,314,310 A * 5/1994 Bachellier ..... B01F 7/00341 366/265
5,358,671 A 10/1994 Leiponen
5,616,083 A 4/1997 Subbaraman et al.
5,938,332 A * 8/1999 Bachellier ..... B01F 7/00341 366/330.1
7,191,613 B2 3/2007 Lee
7,784,769 B2 8/2010 Hoefken
8,240,988 B2 8/2012 Otto
8,240,998 B2 * 8/2012 Otto ..... F03B 17/00 416/183
8,506,244 B2 8/2013 McBride et al.
2003/0147760 A1 * 8/2003 Chiang ..... F04D 29/2288 417/423.1
2008/0247267 A1 10/2008 Clawson et al.
2009/0169374 A1 * 7/2009 Ilves ..... F04D 29/2288 415/206
2012/0061298 A1 * 3/2012 Jameson ..... B03D 1/028 209/166
2014/0003929 A1 1/2014 Favre et al.
2014/0056696 A1 2/2014 Kawano et al.
2014/0349379 A1 * 11/2014 Bachellier ..... B01F 7/22 435/257.1

FOREIGN PATENT DOCUMENTS

CN 204082577 1/2015
EP 1087146 A2 3/2001
GB 436101 A * 10/1935 ..... F24H 3/0405
GB 0811849 4/1959
GB 2136304 A 9/1984
KR 1020110064080 6/2011
WO 2007093668 A1 8/2007
WO 2013082717 A1 6/2013

* cited by examiner

CONICAL IMPELLER AND APPLICATIONS THEREOF

CROSS-REFERENCE TO RELATED APPLICATIONS

This application claims priority to and the benefit of filing of U.S. Provisional Patent Application Ser. No. 61/979,383, entitled "Conical Impeller", filed on Apr. 14, 2014, U.S. Provisional Patent Application Ser. No. 61/985,971, entitled "Conical Impeller", filed on Apr. 29, 2014, U.S. Provisional Patent Application Ser. No. 61/985,962, entitled "Multiphase Mixing Using Conical Impeller", filed on Apr. 29, 2014, U.S. Provisional Patent Application Ser. No. 61/985,941, entitled "Flotation Cell with Conical Impeller", filed on Apr. 29, 2014, and U.S. Provisional Patent Application Ser. No. 61/987,075, entitled "Low Shear Conical Impeller", filed on May 1, 2014. The specifications and claims thereof are incorporated herein by reference.

BACKGROUND OF THE INVENTION

Field of the Invention (Technical Field)

The present invention is related to a non-fouling, self-cleaning conical impeller with circumferentially attached blades attached to an upper hub comprising an interior inverted conical surface. The conical surface preferably comprises an angle sufficient to divert an incoming fluid helix to prevent particles from adhering to the interior of the upper hub.

Background Discussion

Note that the following discussion refers to a number of publications and references. Discussion of such publications herein is given for more complete background of the scientific principles and is not to be construed as an admission that such publications are prior art for patentability determination purposes.

Existing conical impellers, such as those disclosed in U.S. Pat. Nos. 5,314,310 and 5,938,332 and PCT/CA2012/050873 comprise a top hub comprising a flat interior surface; that is, the inside bottom surface of the hub is perpendicular to the axis of rotation, or in other words a horizontal plane when the impeller is oriented vertically. When the impeller rotates and creates an upward spiral helical intake vortex, this vortex collides with the flat surface, compressing and collapsing on itself. In the upper part of the impeller, typically the top third, fluid is discharged from the impeller at a 90 degree angle to the axis of rotation, as shown in FIG. 6, disrupting the otherwise upward flow of fluid from the lower two thirds of the impeller. This results in inadequate discharge to the exterior of the impeller of the fluid in approximately the upper third of the interior of impeller, which then provides resistance to the fluid entering the bottom of the impeller (i.e. a backwash or stall effect), impeding it from moving up to the hub. In addition, particulates or other second phase materials such as paint pigments or algae collide with the flat interior surface and adhere to that surface. This effect is exacerbated by the sharp interior angle where the upper edge of the blade attaches to the bottom surface of the hub. These disadvantages are magnified for impellers greater than approximately four inches in diameter and for those operating at speeds greater than 500 rpm.

SUMMARY OF THE INVENTION (DISCLOSURE OF THE INVENTION)

The present invention is an impeller comprising a hub comprising a lower conical surface and a plurality of spiral arms, each arm comprising an outwardly slanted outer slanted side; and a plurality of blades circumferentially mounted to the hub, an inner surface of a proximal edge of each blade attached to the outer slanted side such that a distal edge of each blade is flared out to define a circumference larger than that of the hub, thereby imparting a generally conical shape to the impeller. The hub and blades are preferably integrally formed. Each arm preferably comprises a downwardly and outwardly slanting upper surface, and the proximal edge of each blade is preferably not parallel to the distal end. The impeller preferably further comprises a ring connecting the distal edges of the blades. The lower conical surface of the hub is preferably formed from downwardly and inwardly slanting lower surfaces of each arm as well as the central portion of the hub. The internal joint between the inner surface of the proximal edge of each blade and a lower surface of each arm preferably comprises a smooth radius. The surfaces of the blades are optionally textured. The lower conical surface optionally comprises one or more orifices for injecting gas into an interior of the impeller, which are preferably in fluid connection with a conduit disposed within an upper shaft connected to the hub. The discharge edge of each blade optionally comprises one or more orifices for discharging a gas. The fluid drawn within the impeller is preferably ejected from the impeller in an upward and outward direction at an angle with respect to horizontal, preferably following a path defined by the intersection of the inner surface of the proximal edge of each blade and the slanted lower surface of each arm, thus enabling the fluid drawn within the impeller to preferably be substantially completely ejected from the interior of the impeller.

The impeller can be disposed in a container such that the distal edges of the blades are approximately located at the midline of the level of liquid in the container. The impeller preferably induces both radial and axial flows of the fluid in the container, eliminating the need for baffles in the container. The axis of rotation of the impeller is preferably offset from a central axis of the container. The container is optionally part of a flotation cell. In operation the surface of the liquid in the flotation cell is substantially undisturbed. Shear imparted to the fluid or materials therein by the impeller is preferably substantially independent of the size of the impeller. A circle generally defined by the distal edges of the blades is optionally greater than four inches in diameter. The impeller can be disposable, sterilizable, or autoclavable, and preferably minimizes or eliminates particle agglomeration and fouling of the impeller. There is preferably a sufficiently low pressure differential between the intake edge and discharge edge of each rotating blade so a multiphase fluid behaves as a single phase fluid.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate embodiments of the present invention and, together with the description, serve to explain the principles of the invention. The drawings are only for the purpose of illustrating certain embodiments of the invention and are not to be construed as limiting the invention. In the drawings.

DETAILED DESCRIPTION OF EMBODIMENTS OF THE INVENTION

Figure 7:
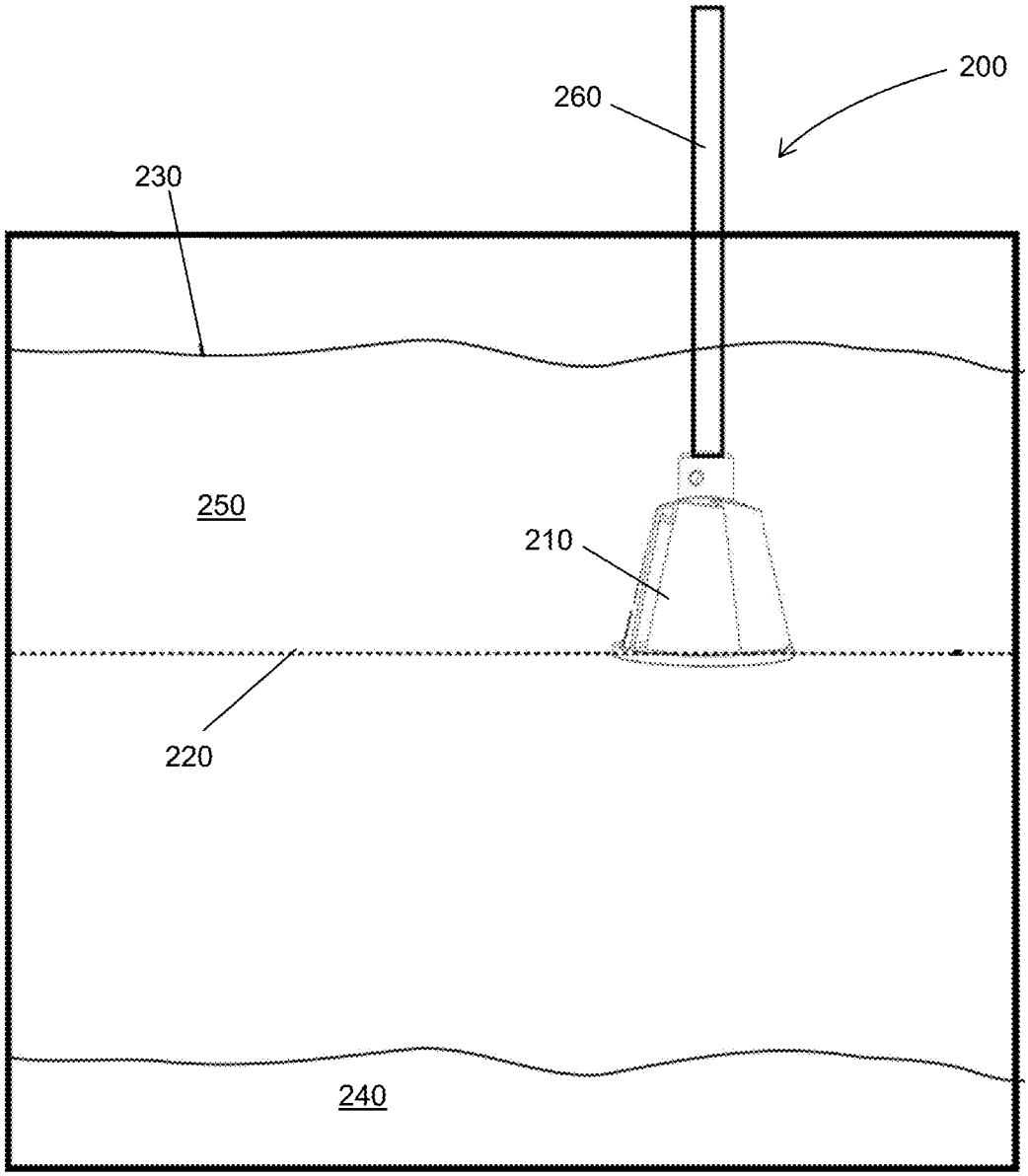
FIG. 7 is a schematic of a mixing reactor comprising an embodiment of an impeller of the present invention.
Figure 8:
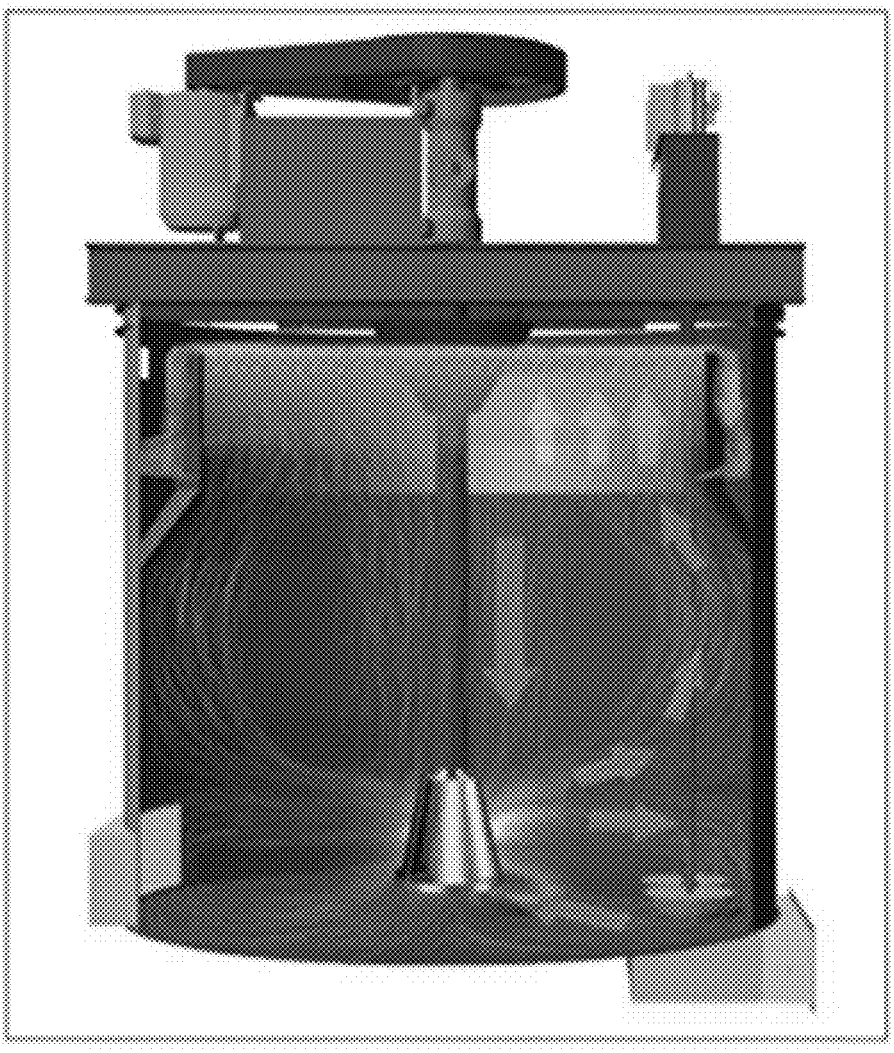
FIG. 8 is a schematic showing axial and radial flows induced by an impeller of the present invention in a flotation cell.
Figure 9:
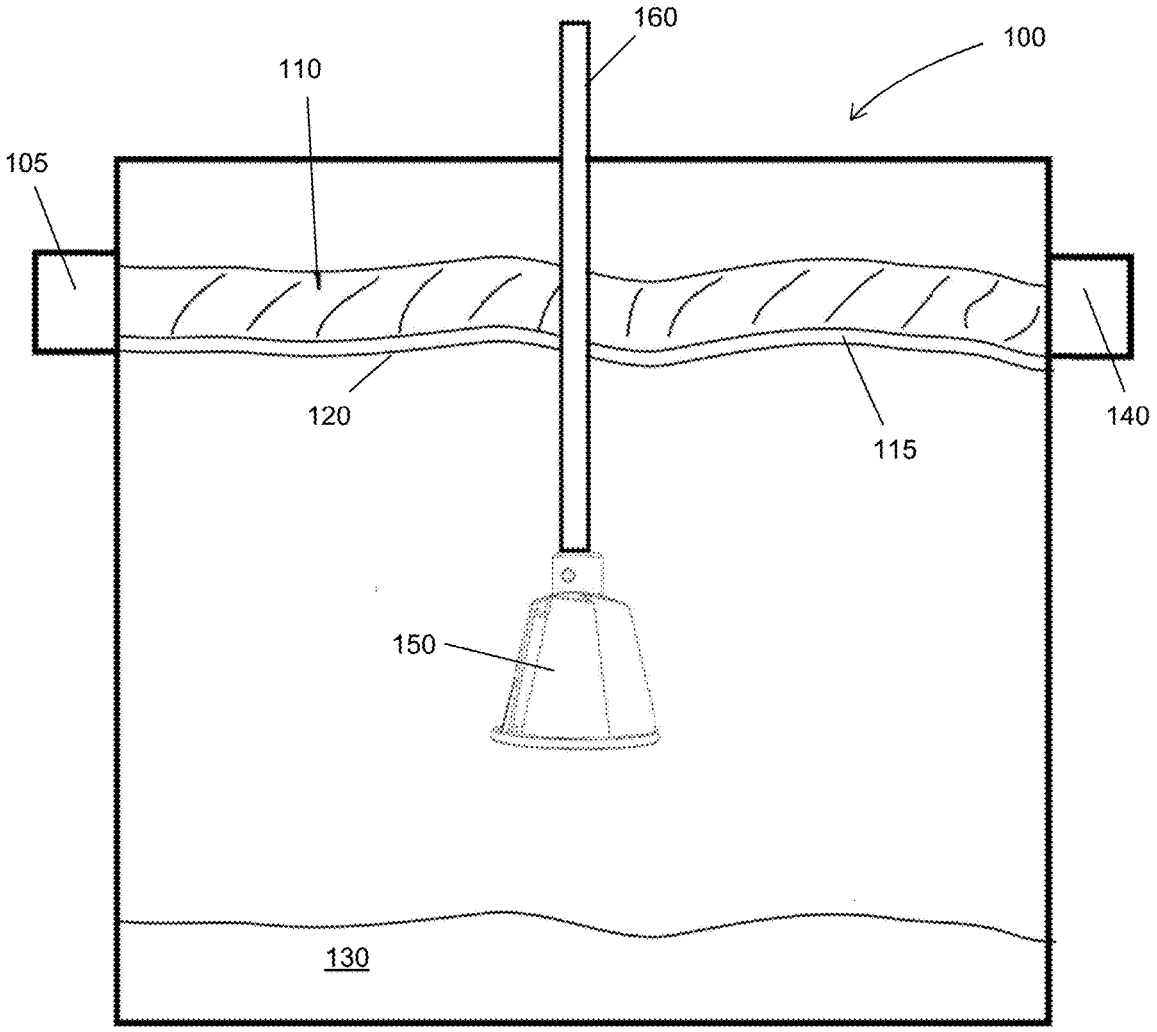
FIG. 9 is a schematic of a flotation cell comprising an embodiment of an impeller of the present invention.

An embodiment of the present invention is a conical impeller comprising an upper hub that comprises an interior, downward pointing conical surface. As used throughout the specification and claims, the term "impeller" means impeller, mixer, bladed or unbladed rotor, vaned disc, propeller, and the like. As used throughout the specification and claims, the term "conical surface" means a surface that is convex, conical, dome shaped, pyramidal, and the like, or comprises a solid shape that is formed when any arcuate or other line is rotated around an axis of rotation; i.e. any surface for which the point furthest from its base is located approximately on the central axis of the surface. As defined herein, a conical surface is typically, but not necessarily, circularly symmetric about an axis of rotation. Although the terms "upper", "lower", "top", and "bottom" are used herein, implying that the impeller is oriented with a vertical axis of rotation as shown in FIGS. 7-9, those terms are used herein as a matter of convenience and it is to be understood that an impeller of the present invention can be used in any orientation.

FIGS. 1A, 1B, 1C, and 1D are side, perspective top, perspective bottom, and bottom views respectively of an embodiment of impeller 1 of the present invention. Impeller 1 preferably comprises a plurality of blades 5 attached to upper hub 10, forming a generally conical shape. The blades are preferably smoothly attached or integrated into the upper hub, providing a smooth surface for fluid ejection. The hub may be manufactured separately from the impeller blades or integrally formed therewith. Upper edge 12 of blade 5 preferably forms angle $\alpha$ with the horizontal when viewed from outside the impeller; a is preferably between zero degrees and 45 degrees. Therefore, when viewed from the outside, inside blade edge 43 is higher than discharge blade edge 45 so that the planes which contain the curved top and bottom edges of each blade are not parallel; that is, blade 5 is preferably trapezoidal. Optional bottom ring 15 centered on the axis of rotation of the impeller connects to the bottom edge of each blade, providing structural stability while preferably not interfering with the fluid flow produced by operation of the impeller.

FIGS. 2A, 2B, 2C and 2D, are perspective top, side, top, and perspective bottom views respectively of an embodiment of upper hub 10 of the present invention. Upper hub 10 comprises a plurality of arms 20 which preferably spiral outward from the central axis of the hub and comprise surfaces 25 for connecting to blades 5. The bottom of upper hub 10, which forms the upper surface of the interior of the impeller, preferably comprises conical surface 30. Upper hub 10 preferably comprises upper shaft 40, which may be integrally formed with, or attached to, the lower portion of the hub which comprises arms 20. Upper shaft 40 connects to a rotating drive shaft for rotating the impeller. In one embodiment of the invention, the rotating drive shaft comprises a strain gauge that measures torque, which in addition to monitoring performance of the impeller can alert the user to replace a broken or worn impeller. As shown, top surface 85 of each arm 20 slants downward; however, for some applications, the top surface may be flat (i.e. planar and perpendicular to the axis of rotation).

FIGS. 3A, 3B, 3C and 3D are cutaway views of impeller 1 showing interior conical surface 30 of hub 10 and smoothed radius 57 on the internal joint where blade 5 attaches to (or is integrated with) hub 10. In prior impellers the internal joint formed a sharp angle which particles could attach to and collide with, allowing material such as paint or algae to adhere to the surfaces. In contrast, the smoothed radius 57 of the present invention helps to prevent fouling, shearing, particle damage, particle collision and particle adherence, thus enhancing self cleaning of the upper hub region of the impeller interior. This also enables the impeller to be used in solutions comprising abrasive particles without undergoing the wear of a typical impeller. In order to further reduce wear, the blade surfaces may comprise texturing, divots or dimples, similar to a golf ball or sharkskin-like textures used on some swimsuits, to reduce drag and improve flow dynamics, particularly for abrasive materials. Other advantages include better control over nanoparticles agglomeration events, enabling a higher rotational speed to be used in some shear sensitive materials, reducing particle abrasion on surfaces and/or fouling events, and controlling adhesion of microbubbles over the blade surface area.

Figure 4:
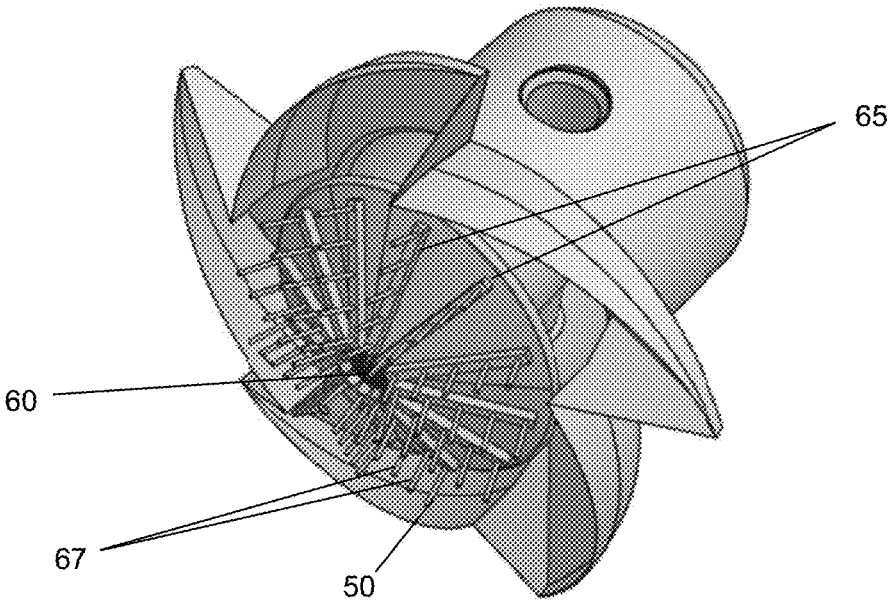
FIG. 4 is a perspective view of the impeller of FIG. 1 in which the hub is transparent to show gas distribution passages.

Conical surface 30 optionally comprises one or more orifices 50 for injecting gas or another fluid into the interior region 55 of the impeller. Gas may be provided to the orifices through conduit 60. In one embodiment as shown in FIG. 4, in which the hub is transparent, distribution passages 65 extend radially outward from conduit 60 and connect with a plurality of passages 67 which each terminate in an orifice 50. The helical discharge flow created by the conical surface preferably prevents agglomeration of microbubbles, particles, or other second phases in the fluid, and the elimination of horizontal discharge flow and collapse of the internal helical flow also reduce bubble agglomeration of the entrained gas and second phase particles.

Figure 5:
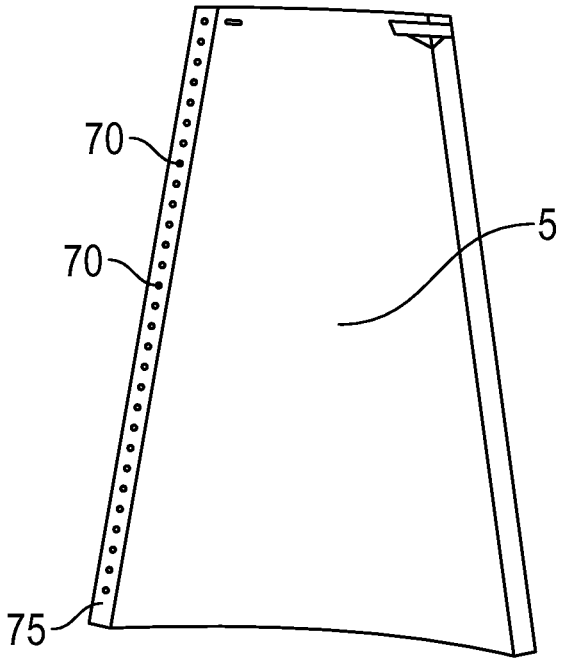
FIG. 5 shows orifices disposed on an edge of a blade of the impeller of FIG. 1.

FIG. 5 shows blade 5 comprising one or more optional orifices 70 disposed along discharge edge 75. Orifices 70 can be used to inject gas or another fluid into the region surrounding impeller 1 and/or directly into the flow of fluid entering into the impeller, thereby enhancing dispersion efficiency of the gas in the fluid. Gas may be discharged through orifices 50 in the upper hub, as shown in FIG. 4, orifices 70 in the discharge edge of the blades, or both.

Figure 1A:
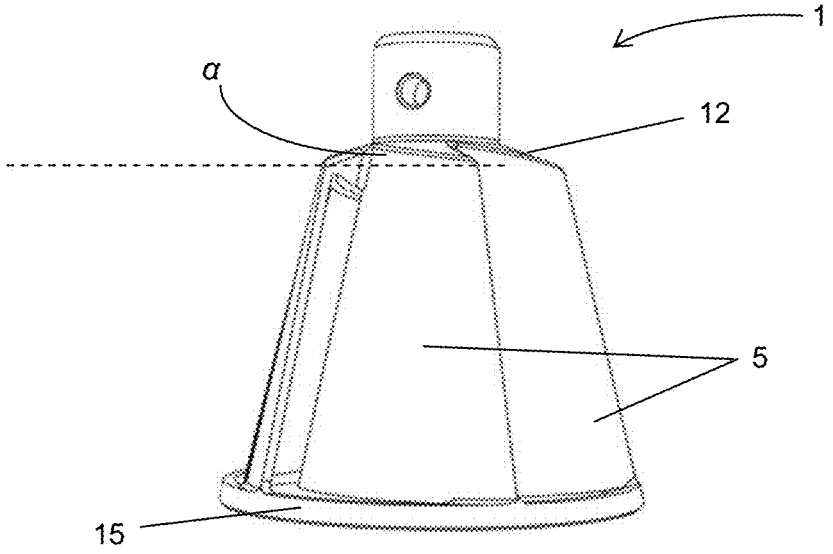
FIGS. 1A, 1B, 1C, and 1D are side, perspective top, perspective bottom, and bottom views respectively of an embodiment of an impeller of the present invention.
Figure 1B:
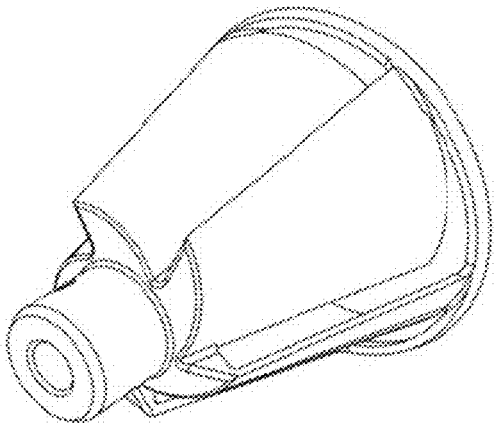
Figure 1C:
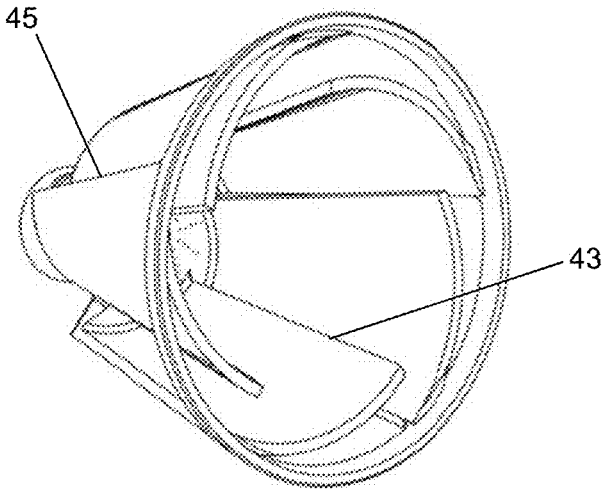
Figure 1D:
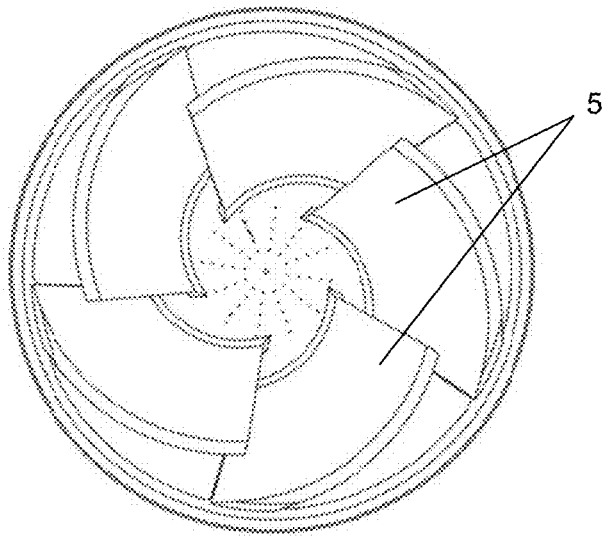
Figure 2A:
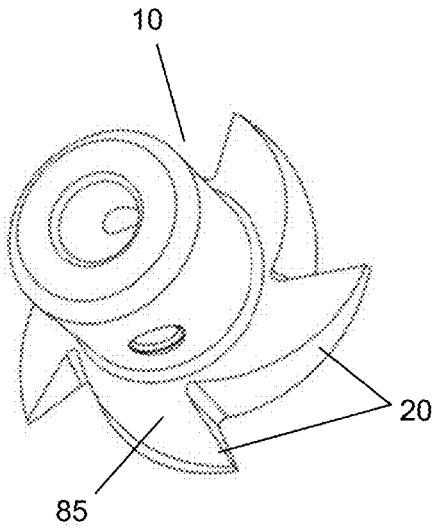
FIGS. 2A, 2B, 2C and 2D, are perspective top, side, top, and perspective bottom views respectively of an embodiment of an upper hub of the present invention.
Figure 2B:
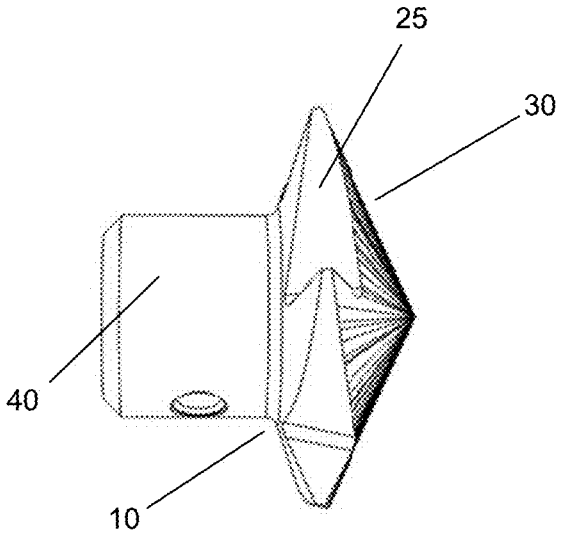
Figure 2C:
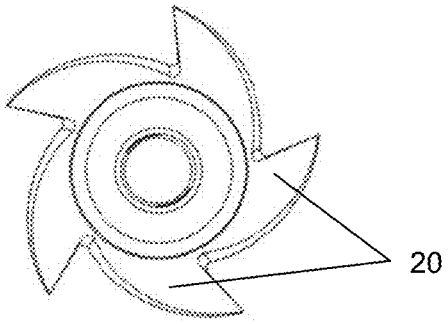
Figure 2D:
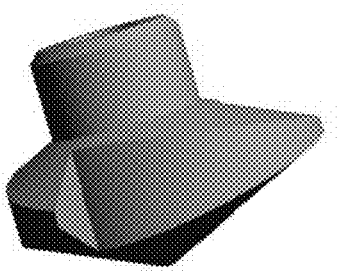
Figure 3A:
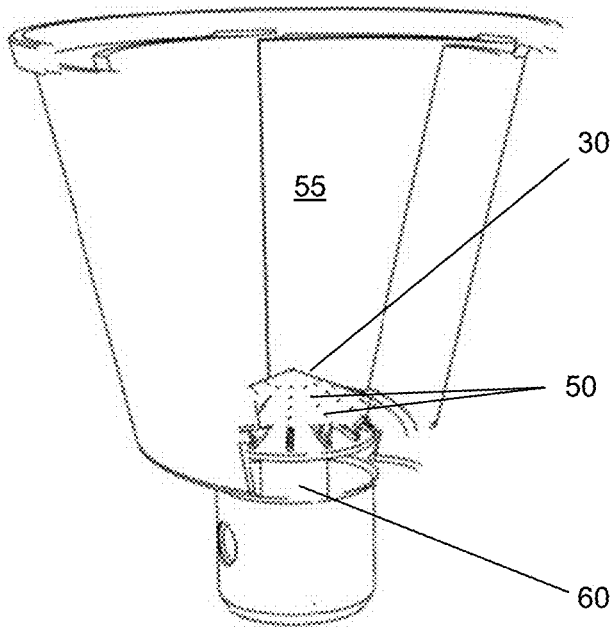
FIGS. 3A, 3B, 3C and 3D are various cutaway views of the impeller of FIG. 1.
Figure 3B:
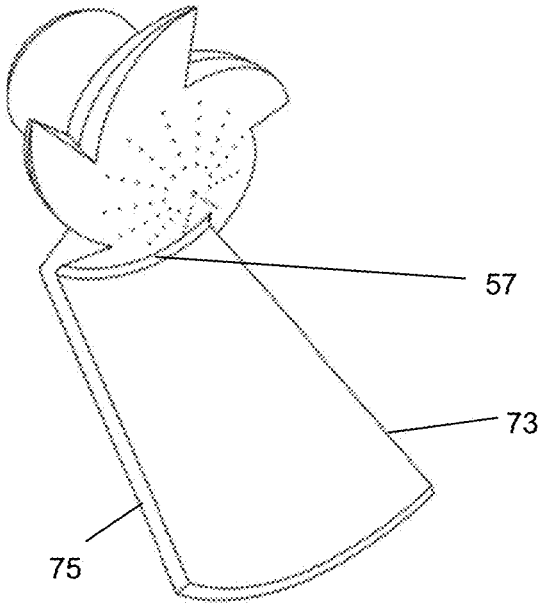
Figure 3C:
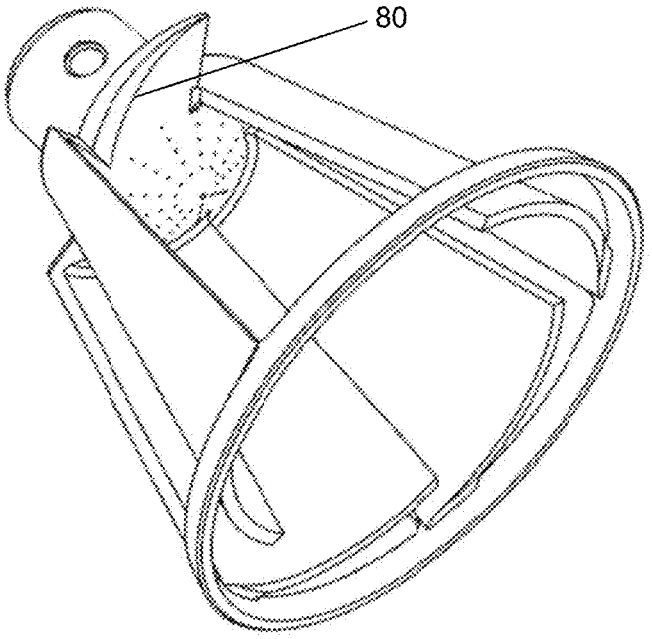
Figure 3D:
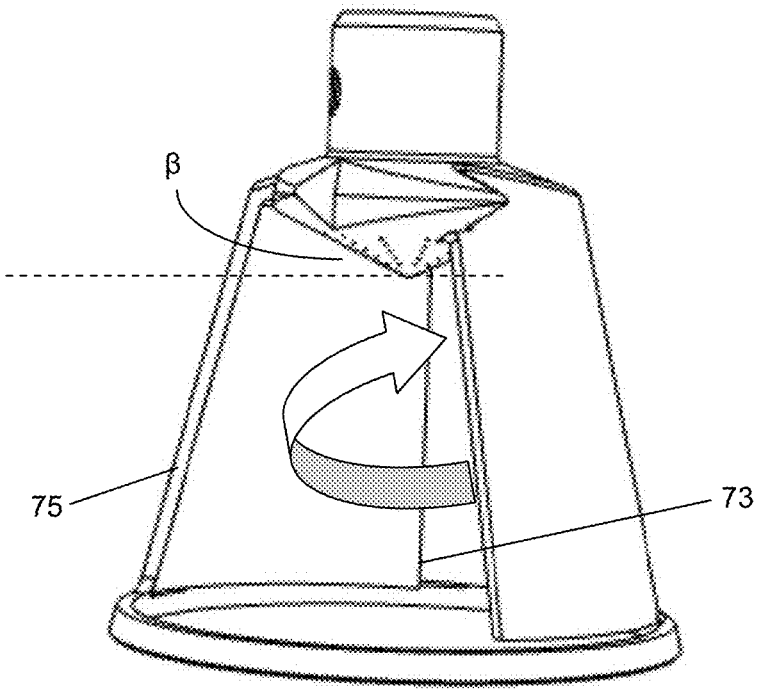
Figure 6:
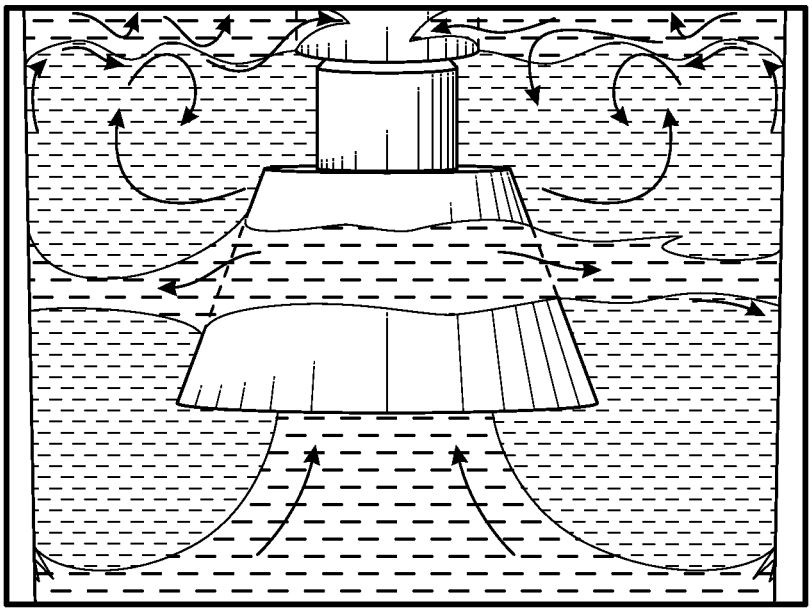
FIG. 6 (PRIOR ART)
FIG. 6 is a photograph showing a fluid distribution produced by an impeller of the prior art.

As the impeller rotates, a prewhirl condition with both a radial and axial component is formed, similar to an inverted tornado. This prewhirl condition rotates the fluid into a helical spiral flow and pulls material from the bottom of the tank into the impeller, where it is discharged outwardly through the openings between the blades. An impeller of the prior art is shown in FIG. 6. As can be seen, darker fluid enters the impeller from below and when it reaches a certain height is discharged approximately horizontally to the exterior of the impeller. Fluid in the upper portion of the impeller (above the darker discharged fluid) is poorly ejected and thus may stagnate. In contrast, as shown in FIG. 3D, the interior conical surface of the hub of the present invention redirects the flow of fluid (indicated by the block arrow) upward and outward at an angle β greater than 0 degrees with respect to the horizontal. Because of the conical surface, when looking at the blade from inside the impeller, discharge edge 75 is taller than inside blade edge 73. In addition, the exterior surface of the blade is slightly larger in area than the interior surface of the blade due to the conical surface. As can be seen in FIGS. 2B and 3C, interior attachment path 80 of the blades to the contoured bottom of the upper hub rises from inside edge 73 of the blade to discharge edge 75, and sweeps around the interior diameter of the blade, following the contour of the hub assembly with a helical component that arcs and elevates at the same time. This path produces a smooth, radial flow of fluid upward and outward as shown in FIG. 3D. The flow ejected from the upper part of the impeller preferably generally follows the contour of the conical surface and is directed upwards, out of, and away from the impeller.

The conical surface upper hub interior preferably prevents the collapse of the intake vortex and directs the ejected flow away from the impeller, eliminating internal flow back and particle collision, which creates a self cleaning and non fouling effect. Further, the interior conical surface of the upper hub preferably provides a stable and less turbulent discharge flow at exit, allowing the upper third of the impeller to substantially completely evacuate fluid from the interior of the impeller, thereby eliminating slowly ejecting, stalled, or stagnant fluid, which provides resistance to fluid entering the impeller. Fluid ejection or discharge, i.e. the volume ejected per unit time, is increased, preferably by more than twenty percent, and substantially no fouling or particle adherence takes place. In addition, surface mixing, particularly at speeds lower than 500 rpm, is improved, and the ability to add materials into the tank from the surface and draw those materials into the flow of the impeller is preferably increased by approximately twenty percent. In addition, impellers of the present invention enable gas entrained fluid to be inserted upwardly into the flow.

For improved mixing results, it is preferably that the intake (bottom) of the impeller is positioned at approximately the midline of the liquid level in a container, and the axis of rotation is offset from the central axis of the container. In this configuration the impeller of the present invention preferably does not create a vortex or bubbles at the surface of the liquid. However, in some embodiments of the present invention an impeller may be inverted to create a controlled vortex to draw down surface material into a vessel, optionally in combination with a non-inverted impeller which can be used to suspend solids and prevent them from settling.

The impeller of the present invention may be used in a single tank without baffles to produce a batch process. Alternatively the impeller may be used in a multi stage reactor, continuous flow configuration, enabling fluid to be mixed in successive vessels or in one vessel divided by a series of baffle plates. These plates divide a single vessel into zones which are successively more completely mixed.

The impeller of the present invention may be used as a pump, such as an inline pump. Possible applications include removal of hydraulic fracturing fluid from a borehole, and low shear circulation of blood in open heart machines. Some embodiments of an inline system in a pipe do not require an upper hub; the blades could instead be attached directly to the internally surface of a pipe. Mixing could occur between stages of blades and while moving through the pipe.

Low Shear Mixing and Scale Up for Shear Sensitive Materials

Currently, many shear, temperature, and/or pH-sensitive advanced materials in the biotech, pharmaceutical, and biofuel industries (e.g. algae, biopolymers, drugs, plasma, red blood cells, blood products, insulin, and polymers) can be successfully produced and manufactured in small vessels (such as two liter flasks) but not in a larger tank. Many of these shear sensitive materials cannot be produced in larger volumes because the dynamics of conventional mixing technology do not scale well in materials for which shear damage is a major concern. Current technology scale up is inefficient using traditional turbines and propellers due to requiring significantly more horsepower, larger diameter turbines or propellers, baffles, and greater tip speeds to provide adequate solids suspension and blending. These result in uneven mixing and zones of high shear at the outer edges of the propeller or turbine due to the increased tip velocity of larger diameter propellers or turbines, where shear sensitive materials can be damaged. In addition, these methods typically suffer from inadequate and uneven mixing throughout the reactor vessel, resulting in uneven temperature and/or pH distribution and dead zones that not only affect many biological processes, but also whose poor mixing results in the agglomeration of tiny particles and ultimately leads to the failure and death of the process within the reactor. Furthermore, conventional propeller or turbine technology relies heavily on turbulence to create stable particle distributions, and also relies on the high-pressure differential between the back and face of the blade, manifested as thrust in propulsion, or head in pumps.

In fluid dynamics shear stress is a function of velocity in Newtonian and non Newtonian fluids. In Newtonian fluids the viscosity remains constant with increasing rates of force, but in non-Newtonian fluids viscosity changes as the shear stress imparted to the fluid is increased. For example, in liquid form cornstarch looks very much like water and acts like a low viscosity fluid. However, when shear stress is increased the viscosity increases, and liquid cornstarch becomes less fluid and would not even splash if a container of it is disturbed. In another example, soap is a shear sensitive material because it begins to foam when subjected to a shear force. Shear can occur by suddenly changing the direction of a fluid or by suddenly accelerating a fluid, especially when that acceleration is not uniform. Thus zones of excessive turbulence, sudden changes in fluid flow direction, and flow back can cause shear events. Shear stress can also produce temperature increases in the fluid as mechanical energy is converted to heat.

Non-turbulent fluid mixing produces much lower shear than using a mechanical device to create turbulence, due to the higher velocity changes seen in such turbulent flows. The impeller of the present invention preferably creates a less chaotic, less turbulent method of particle distribution throughout a vessel and creates a stable circulatory flow within a tank, so that introduced material is evenly distributed throughout in a shorter period of time. This results in less shear and impact to fluid. Scale up between lab scale mixing and pilot or manufacturing scale mixing is easier using the impeller of the present invention rather than other impellers, since shear forces do not substantially increase with impeller diameter, and flow through the impeller is easily calculated for a larger impeller at a given speed. Intake and discharge velocities of the present impeller are substantially stable, reducing shear stress events. Thus very advanced biomaterials and shear sensitive organics can be mixed in much larger volumes without any cell damage or breakage of delicate polymer chains. The present invention is particularly useful for applications where highly shear sensitive and/or nanomaterials can grow in a stable medium to create a homogenous mixture in a large reactor vessel. Further, the process of the present invention is preferably faster, requires less man hours and personnel, and lowers the electrical consumption of the overall process by reducing blend times by as much as five times in very low viscosity. The ability to control the circulatory time of shear sensitive materials in a vessel by either increasing or decreasing the strength of a highly controlled circulatory flow without shear increasing is desirable. In addition, impellers of the present invention can be relatively inexpensive and disposable, or alternatively be designed to be sterilizable or autoclavable.

Existing conical impellers comprise an upper hub with flat exterior and interior surfaces, which at higher revolutions per minute (rpm) and larger diameters caused a collapse of the intake flow and resulted in a flowback effect in which fluid pushes back against the incoming helical flow. Nanoparticles adhere to such flat rotating surfaces, and highly shear sensitive materials at larger scale encounter velocity differential, high shear zones in the transition area around the hub. However, the interior conical surface of impellers of the present invention equally distributes the intake flow and carries it into the discharge zone exterior of the impeller assembly. The interior conical surface is continued along its plane toward the interior upper discharge zone of the upper blade attachment. Further, the upper surface may have a similar profile to eliminate a flat surface on the top, outer surface of the upper hub. This can minimize velocity differential zones that occur when accelerated fluid passes at an angle past the upper surface of the hub. This upper surface contour may be the inverse of the lower assembly to improve upper circulatory flows above the impeller, and/or it may be fully molded into a smooth transitional surface into the main hub assembly where the drive shaft attaches.

The present impellers evenly distribute the intake vortex flow upward and outward, resulting in substantially complete fluid elimination in the upper interior region of the impeller. Further, the upwardly contoured discharge area where the blade meets the upper hub assembly prevents particle agglomeration and sudden changes in direction of the fluid, further reducing shear stresses on shear sensitive fluids. The device is low shear because the interior of the impeller and the exterior of the impeller do not have a high-pressure differential from lower to higher pressure, as is the case in propeller type mixers, and the impeller preferably maintains a stable particle velocity along the entire length of the blade at discharge. Reduced pressure differential between the inner and outer faces of each of the blades of the present impeller also helps to reduce or eliminate high shear zones in the apparatus. As the present impeller diameters are scaled up (i.e. the volume discharge rate is increased for a given rpm, the impeller geometry does not produce the same tip speed problems as seen in propellers or turbines. Impellers of the present invention have been used to mix algae (550 rpm/300 cm/sec$^2$) in a bioreactor with no cell damage, and provide even light exposure to all of the algae present.

It is difficult to mix nanoparticles using the turbulent, chaotic methods used previously. This is because these methods do not prevent agglomeration, where small particles have a tendency to clump together due to van der Waal effects, and close proximity collisions inherent in mixed vessels with non-uniform zones of particle distribution. In contrast, the impeller of the present invention preferably minimizes or eliminates particle collisions, and the steady state, non-chaotic flow characteristics allow even distribution of nanoparticles in a uniformly distributed flow within a vessel. For small particles, the impeller preferably does not comprise bottom ring 15; this configuration improves efficiency and helps maintain stability at high rotational speeds.

Multiphase Fluids

Impellers of the present invention may be used in reactors for mixing slurry and other two phase or multiphase fluids that comprise solids, liquids and/or gases. For liquids that include solids, such improved reactors provide up to 50 percent better solid suspension than mixing reactors using conventional turbines. The present impellers are also at least twice as effective as conventional turbines at mixing gas with liquid; and operate with a non-turbulent fluid surface, allowing at least a 100 percent increase in the speed of chemical reactions due to the enhanced manner with which the intake vortex is evenly distributed by the upper hub assembly. As slurry, liquids, solids and gas are treated in mixing reactors, enhanced particle distribution results in mixing times up to five times faster in low viscosity materials, and up to three times faster in materials up to 5000 centipoise.

The present invention provides near complete solids suspension so that few if any solid particles are allowed to settle on the bottom of the mixing reactor. As described above, the upper hub assembly prevents particle agglomeration and flowback, providing a self-cleaning feature that prevents fouling in the impeller. The impeller flow is characterized as a conical helix flow that discharges outwardly and away from the impeller rather than straight up. The discharge flow pattern preferably does not create surface turbulence or surface splashing, which is a result of lost mechanical energy. The previously described interior hub defines the discharge flow outwardly and upwardly, and enables the area immediately above the impeller to provide a downward fluid flow zone useful, for example, for the addition of chemicals, without turbulence seen in previous impellers, particularly those larger than 4 inches in diameter and/or running at speeds greater than 500 rpm. Embodiments of the present impeller have a pumping efficiency sixty percent higher than conventional turbines; this aids in providing a stable and calm surface to prevent surface air from being entrained into the fluid. In addition, the impeller in the reactor vessel requires 50 percent less horsepower at the drive shaft than a typical turbine or propeller mixer, thereby reducing the power required to mix materials in a process cycle. Such properties make processes such as chemical mechanical polishing (CMP) more efficient.

The impeller of the present invention preferably minimizes the pressure difference between the outside and inside of the blade, allowing gas bubbles to be entrained and mixed without the impeller stalling or flooding. The inside conical surface of the upper hub assembly of the impeller preferably enables gas bubbles to be pumped upwardly and outwardly, as opposed to a more horizontal direction as in prior impellers, and prevents a backflow and collection of fluid in the upper one third of the impeller. This minimizes gas bubble agglomeration and maintains a steady state stream of small gas bubbles to be mixed within the discharge flow of the impeller.

The efficiency of a mixing reactor vessel is determined by particle distribution, contact and reaction. The present reactor has increased efficiency by improving solids suspension, thereby increasing particle distribution, improving bubble distribution, thereby improving particle-bubble contact, and reducing surface agitation due to reduced energy transfer to the liquid in the vessel. Gravity forces solids to the bottom of the tank; most conventional mixing technology, which pumps suspended material down, relies on fluid displacement upwardly to prevent particles from collecting on the vessel bottom. In contrast, the present invention draws solids upward through the impeller structure and evenly distributes it through the upper hub assembly. Because the blades of the present impeller preferably smoothly integrate into the upwardly sweeping contour of the conical surface of the upper hub, material does not abrade or collide with the impeller structure due to a sudden change in direction. The present invention improves the intake vortex integrity and performance by up to thirty percent, by allowing the upper part of the impeller to completely discharge and not be impeded by a flat upper hub assembly.

As shown in FIG. 7, impeller 210 is preferably installed with the largest diameter (i.e., in vertical installations, the bottom) of the impeller placed approximately at midline 220 of fluid level 230 in mixing reactor 200 to maximize the intake flow and balance it with the discharge flow. Solids 240 to be suspended in fluid 250 initially rest on the bottom of reactor 200. Gas may optionally be injected through shaft 260, in which case the conical surface of the inner hub preferably acts as a manifold and comprises a plurality of openings for gas to be introduced into the fluid flow. Unlike previous impellers, the helical inflow now intersects with the upper conical surface and the flow evenly breaks away, improving gas bubble dispersion to the upper assembly and preventing gas bubble agglomeration. In prior impellers, the helical inflow collides with an upper flat surface, creating flowback and compression that causes small air bubbles to coalesce and prevent uniform bubble generation. In addition, the impeller blades may comprise a plurality of orifices along the discharge side of the blade; preferably the orifices are smaller than or equal to approximately 2 millimeters in diameter. These orifices contribute to mixing gas with the liquid in the flotation vessel. Bubble sizes are preferably smaller than about 4 mm, and more preferably small than about 2 mm, to provide adequate gas bubble distribution in the mixing reactor. Optionally an external source may entrain microbubbles in the reactor vessel. At these bubble sizes the impeller reduces gas entrainment and increases solids suspension, thereby reducing the need for surfactants by up to 10 percent. The stabilized vortex production and discharge result in up to 20 percent improvement in solids suspension and improve the surface area contact with gas and surfactant by a factor of 2.

Suspended nanoparticles can behave unusually when in close proximity to each other. Brownian motion (random movement of very small particles) and Van Der Waal forces (attractiveness of small particles to each other) interfere with efficient particle distribution in a vessel. Many nanoparticle suspensions comprise soap-like or glycol based mediums in order to provide a thicker suspension to attempt to overcome these effects. These mediums can be shear-sensitive, adding further complication to high-speed particle dispersion. Impellers of the present invention preferably provide non-chaotic mixing, or more accurately uniform particle distribution, within a vessel. Rather than rely on turbulence, chaos, and extended time to achieve blending, embodiments of the present invention create a stable, conical helical flow that can evenly distribute particles throughout a vessel in a measurable amount of time. Because the impeller provides both an axial and radial flow in the tank, no baffles are required, thus eliminating related turbulence. The highly controlled circulatory flow preferably comprises sufficient velocity vectors to overcome Brownian motion or Van Der Waal forces, eliminating agglomeration. The flow also minimizes particle collision or further particle degradation. The intake prewhirl prevents collision with the impeller itself, and as such, the device does not wear significantly, even in highly abrasive environments.

Produced Water

Impellers of the present invention may be used for removing hydrocarbons and other dissolved contaminants in produced water created during the extraction of oil and gas. Oil and gas drilling operations consume vast amounts of water. Water is the oil and gas industry's primary by-product and its largest volume waste stream. Advanced drilling techniques such as fracking are driving growth in unconventional shale gas exploration. Worldwide, more than 315 million bbl/day of wastewater are being generated. The U.S. alone generates approximately 70 million bbl/day. The rate of increase for produced water generation is estimated at 9-10% per year as approximately 20,000 new wells are drilled in the U.S. each year alone. Contaminants consist in some cases of cations such as calcium, magnesium, sodium, potassium, aluminum, barium, strontium, Iron, chromium, copper, molybdenum, nickel and selenium; anions such as bicarbonate, sulfate, and chloride; organics such as acetone, benzene, 2-Butanone, toluene, ethylbenzene, xylene, 2-Hexanone, 1,2,4-Trimethylbenzene, 2,4-Dimethylphenol, Benzo[ghi]perylene, Benzoic Acid, 2,4-Dimethylphenol, Isophorone, 2-Methylnaphthalene, 2-Methylphenol, 4-Methylphenol, naphthalene and phenol; and other constituents that may also include, but are not limited to, silica, boron, carbon dioxide, free oil and grease, ammonia and hydrogen sulfide.

Typically a removal medium such as a gas attaches to and removes the extraneous components of contamination from the produced water, precipitates them out, and recovers them. Dispersing and dissolving gas into liquids is inefficient using traditional turbines and propellers due to a condition known as flooding, whereby excessive gas stalls conventional propellers, mixing efficiency drops, and gas-liquid mixing decreases in effectiveness. Maximizing the amount of time a gas bubble is in contact with contaminated water, and improving the distribution of the gas bubbles in a vessel, improves the overall efficiency, speed and effectiveness of a gas stripping apparatus. Controlling the retention time of entrained bubbles in a vessel by either increasing or decreasing the strength of a highly controlled circulatory flow is thus desirable. The apparatus of the present invention is suitable for fully entraining injected gas into the liquid so as to maximize its consumption in a chemical process to remove and/or enable the precipitation of the contaminants. The present invention may be used for applications where gas is injected into liquid to create a homogenous mixture, recover and precipitate hydrocarbons, and transform wastewater into reusable or less contaminated states.

Embodiments of the present invention can effectively treat produced water for the oil and gas industry by enhancing the dispersion and entrainment of gas particles, increasing residence time, and increasing absorption and release of dispersed and entrained gas particles. Thus the removal of hydrocarbons and contaminants is enhanced, so that the treated produced water may more efficiently be reused, and captured hydrocarbons and other materials may more easily be disposed of or recycled for their value. A containment vessel of the present invention is preferably sealed to prevent gas escape and preferably comprises one or more containment compartments for mixing natural gas, methane or other suitable gases for contaminant removal and a separation system of precipitate and treated water.

The invention preferably provides a low shear vortex flow that also provides a method of gas introduction into the discharge flow, entraining the gas bubbles until they react with the contaminants in the tank. This feature results in a gas utilization increase, and eliminates the escape of gas bubbles from the vessel. Dissolved air and gas flotation vessels and other gas-liquid contact processes can be improved by the present impeller's ability to inject gas directly into the impeller discharge flow, maintain entrainment and improve the efficiency of the overall process of treatment. The present invention requires less size and energy consumption of external compressors required to feed gas into the system due to direct injection of the gas into the discharge flow, for example through orifices in hollowed blades.

As schematically shown in FIG. 8, the impeller of the present invention preferably induces both an axial and radial controlled circulatory flow and provides a means of gas introduction into the discharge flow that has a conical helical, axial and radial outward flow from the axis of rotation and allows entrained gas bubbles, to be trapped as particles and recirculated by means of a circulatory flow back into the intake vortex of the impeller. For example, chemicals such as ozone can be injected and mixed in the spaces between the plurality of rotating blades. The flow is preferably characterized by a forced intake vortex caused by a low pressure zone with a radial component, and subsequent axial component drawing fluid in a circular fashion toward the eye of the rotating device and impelling fluid. The gas entrained flow (i.e. multiphase fluid) is preferably regarded as a single phase fluid due to a low pressure differential between the intake side of the rotating blade and the external side of the rotating blade where the discharge flow occurs and gas is introduced, preventing gas particles from expansion and or compression resulting in a stalled or flooded condition. This flow pattern preferably results in low surface turbulence in the vessel and the formation of a circulatory flow that allows the fluid to move down the vessel wall to be pulled in again by the intake vortex. The gas introduction preferably provides sufficiently small enough bubbles to be entrained by a strong circulatory flow, that strength determined by rotational speed and blade angle allowing the entrainment and controlled release of gas bubbles from the liquid in the vessel. As a result, the gases or chemicals are preferably distributed evenly throughout the vessel.

Flotation Cells

Flotation cells are used to separate and extract minerals from a slurry. Ore particles are treated to make minerals hydrophobic, whereupon mineral particles are attached to small gas bubbles, float to the surface, and collect in a surface froth on the surface of the cell to be collected and recovered. It is important that efficient mixing occurs to ensure all mineral particles are treated and have the opportunity to attach to the gas bubbles. A typical flotation cell comprises a tank, a source of gas bubbles, and a rotating set of vertically oriented blades. This design is not very effective in providing solids suspension, mixing, and circulation of gas bubbles, and at higher speeds creates surface turbulence that breaks up the generated froth where the mineral is recovered. In particular, dispersing and dissolving gases into liquids in typical cells is inefficient using traditional mixers, due to the limited ability to keep small bubbles and chemicals evenly mixed in a tank and the higher energy consumption of the designs. Conventional flotation cells rely on internal baffle plates to enhance mixing, which cause significant turbulence at each baffle plate. Gas is typically released at the bottom of the tank and the rotating blades are relied on to provide sufficient solids suspension to expose the maximum surface area of all of the ore particles.

Impellers of the present invention may be used in a flotation cell, providing a more efficient and complete suspension of solids, a better mixing of reagent to achieve a hydrophobic surface on particles, an improvement in gas dispersion to provide intimate contact with particles, and a less turbulent surface flow in the vessel to prevent breakup of generated froth and improve the overall strength and amount of froth generated. In contrast, the present invention is a less chaotic method of particle distribution throughout a vessel, without requiring baffles, and creates a stable circulatory flow within a vessel so that gas and reagents are evenly distributed throughout in a shorter period of time, with a lower pressure drop, and a lower consumption of energy and a more stable froth layer at the top of the tank.

Further, the process is faster, and lowers the power consumption of the overall process by reducing blend times by eliminating the time ordinarily required to compensate for poor blending. Controlling the circulatory time of entrained chemicals in a vessel by either increasing or decreasing the strength of a highly controlled circulatory flow is desirable. The apparatus of the present invention is particularly suitable for efficiently mixing chemicals into the liquid so as to complete its consumption during the chemical reaction that renders the mineral particles hydrophobic, enabling them to attach to gas bubbles and be transported to the surface. The present invention is thus particularly suitable for applications where (i) dry, liquid and/or gaseous chemicals are injected into another liquid to create a homogenous mixture, (ii) separate components, are recovered and precipitated, and (iii) generated froth is transformed into recoverable minerals. The present invention preferably improves the solids suspension, gas distribution, and contact time between reagent, gas and solids. The invention preferably provides a low shear vortex flow that enables chemical introduction into the discharge flow, entraining the chemical until it reacts with the ore pulp. This feature results in increased chemical utilization and lowers the mixing time, thus shortening the process time to recover the minerals.

Flotation cells of the present invention, unlike existing flotation cells, provide up to 30 percent better solids suspension than mixing using conventional turbines, and at least twice as effective as conventional turbines at mixing gas with liquid. In some applications substantially complete solids suspension is achieved, so that few if any ore particles are untreated. In addition, as described above, the conical helix discharge flow pattern of impellers of the present invention discharge the flow outwardly and away from the impeller rather than straight up. This does not substantially disturb the surface of the liquid in the flotation cell, so the surface remains substantially stable and calm. A non-turbulent surface produces at least a 25 percent increase in froth generation, particularly froth thickness, and thus enhanced mineral recovery yield.

Impellers of the present invention preferably have a pumping efficiency up to sixty percent higher than conventional turbines, producing a calm surface, since surface turbulence or surface splashing is typically a result of lost mechanical energy. In addition, the present impellers require up to fifty percent less horsepower than a typical turbine or propeller mixer, thus reducing the power required to recover minerals in a process cycle. The efficiency of a flotation cell is determined by particle-bubble contact and attachment and froth generation. Improving solids suspension and bubble distribution will therefore increase particle-bubble contact, and reducing surface agitation of the flotation cell will improve froth generation and the thickness or volume of froth. These improvements, together with up to half the power usage, translate into fewer cells required to recover the same amount of mineral, since flotation cells are typically operated in series to optimize mineral recovery over several repeated steps using additional flotation cells.

As shown in FIG. 9, a flotation cell 100 of the present invention comprises pulp intake 105, froth 110 floating on top of fluid surface 120, ore solids 130, and froth recovery mechanism 140. Between froth layer 110 and fluid surface 120 may be slurry layer 115. Impeller 150 is preferably installed with the largest diameter (i.e., for vertical orientations as shown, the bottom) of impeller 150 placed at approximately the midline of the fluid depth in the flotation cell to maximize the intake flow and balance it with the discharge flow. As described above, gas may be injected via shaft 160 and orifices in the impeller blade or upper hub into the fluid. The conical impeller of the present invention improves gas bubble dispersion to the upper assembly and prevents gas bubble agglomeration, resulting in uniform bubble generation. The orifices are preferably smaller than or equal to approximately two millimeters in diameter. In prior impellers, the interior of the flat upper hub created a backflow effect, reducing the discharge effectiveness in the upper one third of the impeller structure and ultimately reducing gas bubble distribution in the upper one third of the assembly. The present invention, comprising a hub with an interior conical surface, prevents inflow collision with the upper surface and flow is evenly distributed along the length of the blade, preventing gas bubbles from agglomerating and becoming bigger in size. Bubble size is preferably smaller than approximately 4 mm, and more preferably smaller than approximately 2 mm, to provide adequate gas bubble distribution in the flotation cell.

At these bubble sizes the present impeller preferably reduces gas entrainment and increases solids suspension, reducing the need for surfactants by up to 10 percent. The stabilized vortex production and discharge results in up to a 20 percent improvement in solids suspension, and improves the surface area contact with gas and surfactant by up to a factor of 2.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. An impeller comprising:

a hub comprising a lower conical surface and a plurality of spiral arms, each arm comprising an outwardly slanted outer slanted side; and a plurality of blades circumferentially mounted to said hub, an inner surface of a proximal edge of each blade attached to said outer slanted side such that a distal edge of each blade is flared out to define a circumference larger than that of said hub, thereby imparting a generally conical shape to the impeller opposite in orientation from said lower conical surface;

wherein a vertex of said lower conical surface is disposed within said generally conical shape formed by said plurality of blades.

2. The impeller of claim 1 wherein said hub and said blades are integrally formed.

3. The impeller of claim 1 wherein each said arm comprises a downwardly and outwardly slanting upper surface and said proximal edge of each blade is not parallel to said distal end.

4. The impeller of claim 1 further comprising a ring connecting the distal edges of the blades.

5. The impeller of claim 1 wherein said lower conical surface of the hub is formed from downwardly and inwardly slanting lower surfaces of each arm and a central portion of said hub.

6. The impeller of claim 1 wherein an internal joint between said inner surface of said proximal edge of each blade and a lower surface of each arm comprises a smooth radius.

7. The impeller of claim 1 wherein surfaces of the blades are textured.

8. The impeller of claim 1 wherein said lower conical surface comprises one or more orifices for injecting gas into an interior of the impeller.

9. The impeller of claim 8 wherein said orifices are in fluid connection with a conduit disposed within an upper shaft connected to said hub.

10. The impeller of claim 1 wherein a discharge edge of each blade comprises one or more orifices for discharging a gas.

11. The impeller of claim 1 wherein fluid drawn within the impeller is ejected from the impeller in an upward and outward direction at an angle with respect to horizontal.

12. The impeller of claim 11 wherein the fluid being ejected follows a path defined by an intersection of said inner surface of said proximal edge of each blade and a slanted lower surface of each arm.

13. The impeller of claim 11 wherein the fluid drawn within the impeller is substantially completely ejected from the interior of the impeller.

14. The impeller of claim 1 disposed in a container such that the distal edges of the blades are approximately located at a midline of a level of liquid in the container.

15. The impeller of claim 14 wherein the container does not comprise baffles.

16. The impeller of claim 14 configured to induce both radial and axial flows of the fluid in the container.

17. The impeller of claim 14 wherein an axis of rotation of the impeller is offset from a central axis of the container.

18. The impeller of claim 14 wherein the container comprises a flotation cell, and wherein in operation a surface of a liquid in the flotation cell is substantially undisturbed.

19. The impeller of claim 1 wherein shear imparted to a fluid or materials therein by the impeller is substantially independent of a size of the impeller.

20. The impeller of claim 19 wherein a circle generally defined by said distal edges of said blades is greater than four inches in diameter.

21. The impeller of claim 1 which is disposable, sterilizable, or autoclavable.

22. The impeller of claim 1 configured to minimize or eliminate particle agglomeration and fouling of the impeller.

23. The impeller of claim 1 comprising a sufficiently low pressure differential between the intake edge and discharge edge of each rotating blade so a multiphase fluid behaves as a single phase fluid.

* * * * *